United States Patent [19]

Hellgren

[11] Patent Number: 4,676,086

[45] Date of Patent: Jun. 30, 1987

[54] PRESS OF PRESSURE CELL TYPE

[75] Inventor: Keijo Hellgren, Västerås, Sweden

[73] Assignee: ASEA Aktiebolag, Västerås, Sweden

[21] Appl. No.: 852,548

[22] Filed: Apr. 16, 1986

[30] Foreign Application Priority Data

Apr. 18, 1985 [SE] Sweden ..... 8501901

[51] Int. Cl.[4] ..... B21D 22/12

[52] U.S. Cl. ..... 72/63; 72/60; 72/54; 29/421 R; 425/DIG. 19; 425/389

[58] Field of Search ..... 72/63, 60, 54, 56, 709, 72/57; 29/421 R; 425/DIG. 19, DIG. 112, 389, 405 R

[56] References Cited

U.S. PATENT DOCUMENTS 3,120,205 2/1964 Pfeiffer et al. ..... 72/63
3,545,241 12/1970 Grankonski et al. ..... 72/63
3,875,778 4/1975 Hellgren .
3,938,361 2/1976 Claesson .
3,949,583 4/1976 Syvakari .
4,315,425 2/1982 Zbornik et al. ..... 72/389
4,573,335 3/1986 Persson ..... 73/63

*Primary Examiner*—Robert L. Spruill
*Assistant Examiner*—David B. Jones
*Attorney, Agent, or Firm*—Watson, Cole, Grindle & Watson

[57] ABSTRACT

A press of pressure cell type comprises a press stand with two opposing force-absorbing elements between which a space is formed. In this space there is located a plate with a recess in which an elastic diaphragm is arranged. The diaphragm forms, together with the plate, a pressure cell. Elongated side supports for the diaphragm are provided at the sides of the said space. A tray insertable into the space forms, together with the plate and the diaphragm, a closed press space. The pressure cell is connected to a pressure medium source. Each side support is formed with an elongated recess, in which there is arranged an expansible membr of elastic material. Each expansible member forms a side support for a press tool located in the tray.

9 Claims, 7 Drawing Figures

PRESS OF PRESSURE CELL TYPE

BACKGROUND OF THE INVENTION (a) Technical Field

The present invention relates to a press of the pressure cell type. Presses of this kind are widely used for shaping complicated sheet metal parts, for example in the aircraft and automobile industries. One advantage is that they can be made with a very large working surface so as to enable the forming of large sheet metal parts in a single pressing operation.

(b) Prior Art

Presses of the kind to which this invention relates are disclosed, inter alia, in U.S. Pat. Nos. 3,875,778 (Hellgren), 3,938,361 (Claesson), 3,949,583 (Syväkari) in commonly owned U.S. patent application Ser. No. 692,716, filed Jan. 18, 1985 and now U.S. Pat. No. 4,573,335, in commonly owned U.S. patent application Ser. No. 823,326, filed Jan. 28, 1986, and in Pamphlet AQ 30-103 E published by ASEA AB of Västeras, Sweden.

Heretofore, the trough- or tray-shaped carrying member, which is insertable into a cavity of the press, has been provided with loose sides, which during the pressing operation are pressed out against surrounding force-absorbing members in the press, usually elongated carrying members for the diaphragm, these carrying members resting against the sides of the press. These and other fill-out elements, which are designed to reduce the stresses on the diaphragm and a die cushion included therein or connected thereto, encroach upon the space and reduce the utilizable volume of the press space. The tool contained in the press space usually consists of a mold which is placed on the bottom of the trough or tray. On this mold is placed the sheet or workpiece to be formed. The sheet is pressed against the tool and is usually folded down against the sides thereof.

OBJECTS OF THE INVENTION

One object of the invention is to provide an improvement in a press of the pressure cell type described above, in order better to utilize the useful volume of the press space. A further object is to provide a press design which will permit large cavity tools of simple materials to be used and deep drawing be carried out thereon without the risk of tool rupture. A still further object is to enable an efficient holding of a sheet metal workpiece during a pressing operation.

SUMMARY OF THE INVENTION

In its broadest aspect, the invention relates to a press of the pressue cell type comprising a press stand having two opposed force-absorbing elements between which a space is formed, a press plate with a recess in which an elastic diaphragm is located and which forms, together with the press plate, an expansible pressure cell, elongated support means along opposite sides of the said space which constitute attachment means for the diaphragm, a tray insertable into said space which, in the inserted position of the tray, together with the press plate and the diaphragm, forms a closed press space, and a pressure medium source for pressurizing the pressure cell to urge the diaphragm against a workpiece on a tool in the tray for deforming the workpiece against the tool which is characterized in that each elongated support means has therein an elongated recess and that an expansible member of an elastic material is arranged in each said recess and forms respective side supports for the tool arranged in the tray during forming of the workpiece.

BRIEF DESCRIPTION OF THE DRAWINGS

The invention will be described in greater detail, by way of example, with reference to the accompanying drawings, in which.

DESCRIPTION OF PREFERRED EMBODIMENTS

Figure 1:
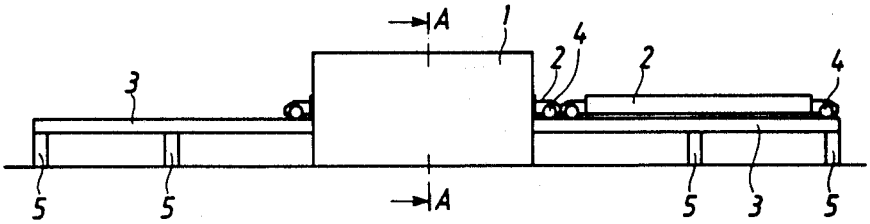
FIG. 1 schematically shows a side view of a press plant.

In the figures, 1 designates a press stand and 2 a trough- or tray-shaped carrying member in which a tool and a workpiece to be shaped against the tool are placed. The carrying member (tray) 2 is provided with transport wheels 4 running on rails 3 supported on columns 5. The tray 2 is displaceable between a position outside the press stand 1, where a pressed workpiece is removed and a new workpiece is placed on the tool, and a position inside the press stand 1 where the tray 2 together with the press stand 1 form a closed press space in which the pressing operation on the workpiece is effected.

For good pressing results and a high accuracy of final pressed shape, particularly in the case of difficult-to-shape sheet materials, high pressing pressures are required. As is shown, the press stand is provided with a pre-stressed wire-wound mantle 10 which serves as a force-absorbing member. The mantle 10 surrounds an upper yoke 11, a lower yoke 12 and two intermediate spacers 13 and 14, or alternately a tube. The mantle 10 is surrounded by a protective sheet 15. The press stand 1 rests on a support 16. The yokes 11, 12 and the supports 13, 14—or alternatively the tube and filling pieces formed as circular segments placed in the said tube—form a space extending through the press stand 1 with an almost rectangular cross-section in a section perpendicular to the press stand 1. When the tray 2 is inserted into this space, it forms together with the surrounding press stand elements a closed press space 27.

Figure 3:
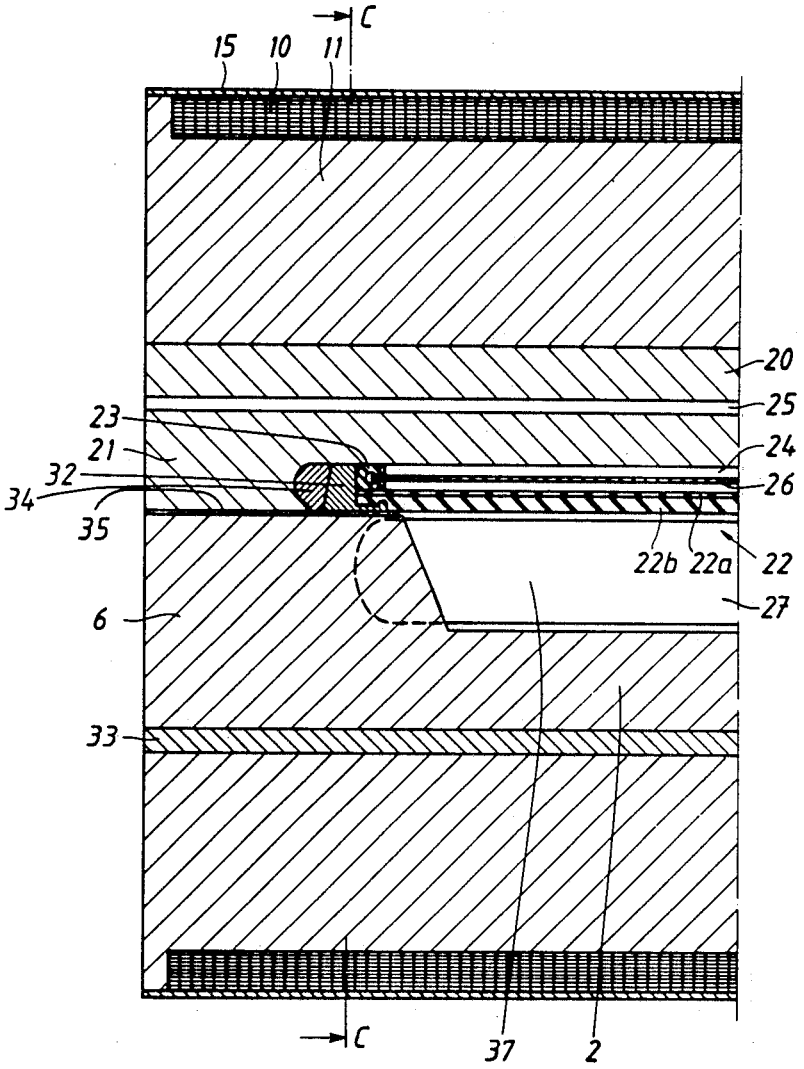
FIG. 3 shows a longitudinal section taken on the line B—B in FIG. 2.

In the upper part of the first-mentioned space there is a press plate 20 with enlarged end wall portions 21 (see FIG. 3). This plate 20 is attached to the yoke 11 in a manner not shown. In the space between the end wall portions 21, a diaphragm 22 is located which is built up of a first layer **22*a* and a second layer 22*b* connected to the first layer. For the layer 22*a*, a material is selected having very good elastic and sealing properties, such as natural rubber or synthetic rubber. The hardness of the rubber is suitably in the range 60° A–80° A. For the second layer 22*b*, a wear-resistant material such as natural rubber, nitrile rubber or polyurethane is selected having a hardness suitable for the pressing. A suitable hardness for this second layer is 90° A. Between the diaphragm 22 and the plate 20 there is located a sealing ring 23 having a substantially U-shaped cross-section. The plate 20, the diaphragm 22 and the sealing ring 23 together form a closed pressure cell 24. The pressure cell 24 is supplied with pressure medium from a pressure medium source (shown schematically at 52 in FIG. 7) through channels 25 and 29 in the plate 20. A diaphragm plate 26 extends between the legs of the sealing ring 23** and acts to stabilize the ring during use of the press.

Figure 2:
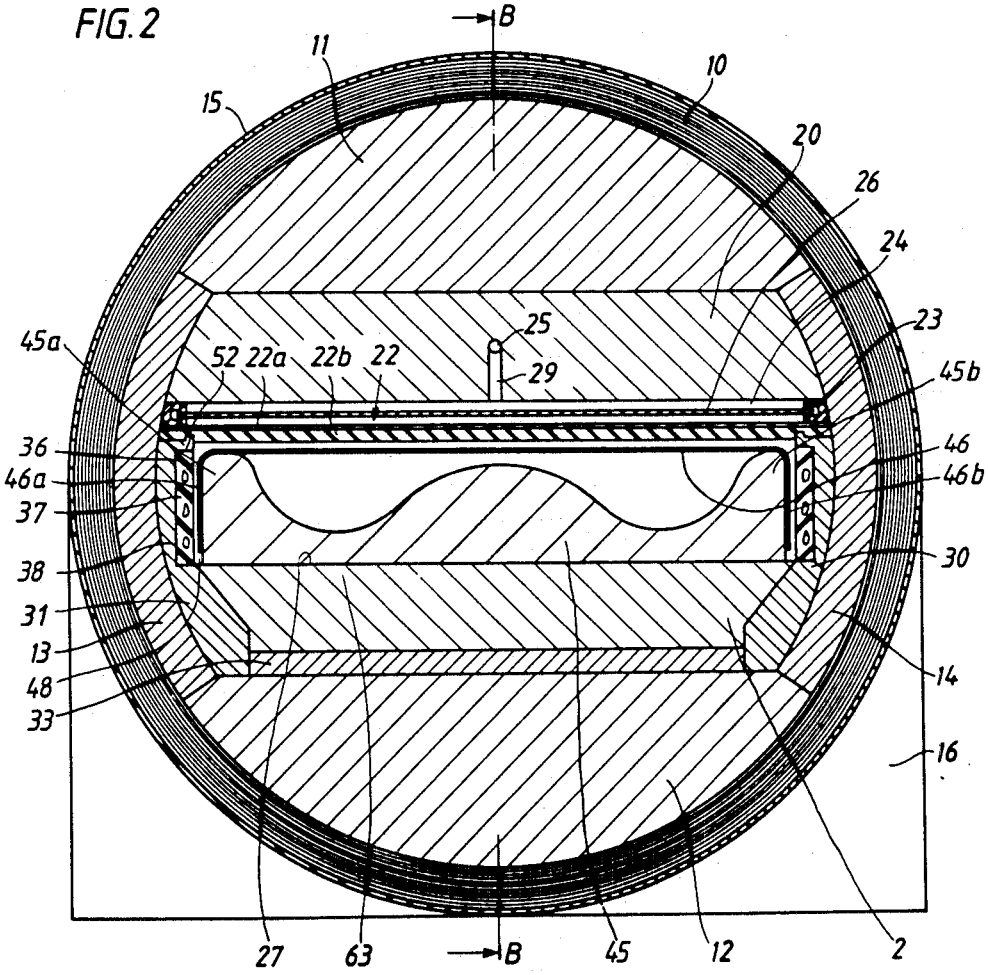
FIG. 2 shows an enlarged cross-section taken on the line A—A in FIG. 1.
Figure 4:
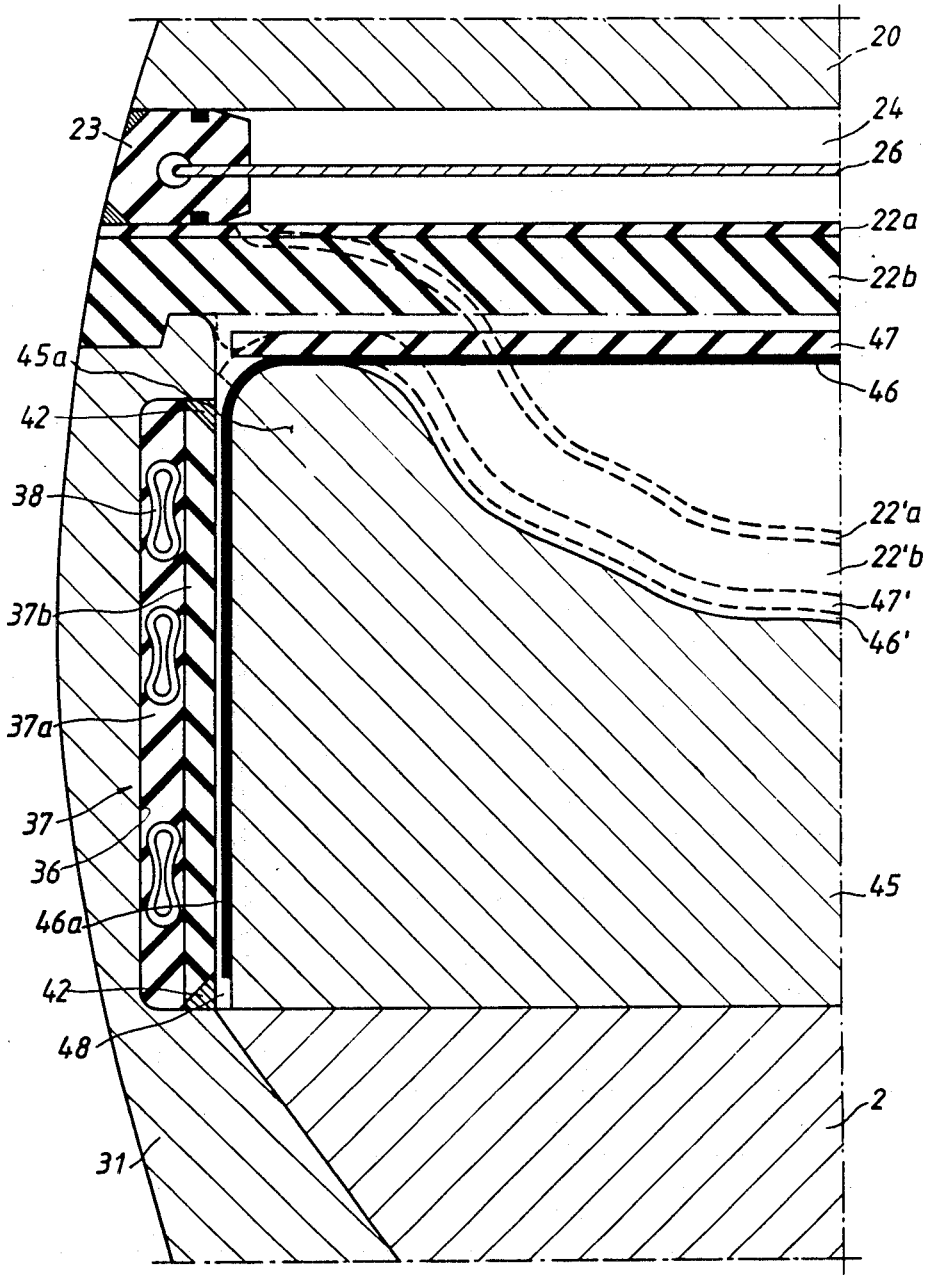
FIGS. 4 and 5 show, on a further enlarged scale, a section of the region on one side of the press space.

The diaphragm 22 is fixed along the sides parallel to the directions of tray movement in the press by means of side supports 30 and 31, respectively, and along the sides at right angles to the directions of tray movement by means of beams 32. The side supports 30, 31 are held in place in the press stand 1 by means of a plate 33 resting on the yoke 12. The beams 32 are vertically movably arranged and are supported by lifting pistons (not shown) in the side supports 30, 31. With a view to increasing its strength, the transition between the mid-portion of the plate 20 and its end portions 21 is made with a large radius and a fill-out bar 34 is located in the plate 20 to allow for a measure of vertical movement of the beam 32. During a pressing operation, each beam 32 is pressed against a respective end portion 6 of the tray 2, thus closing a gap 35 and preventing any extrusion of the diaphragm 22 through these gaps 35. The side supports 30, 31 are each formed with a longitudinal recess 36. In each of these recesses 36 there is disposed a respective expansible member 37, for example an expansible plastic plate of, for example, polyurethane. These expensible members 37 may be cast directly into the recesses 36 and fill these up either completely or partially. Flexible (e.g. rubber) tubes 38 are cast into each plate 37, one end of these flexible tubes 38 being connected to channels 40 (see FIG. 6) leading to a common supply channel 41 which, via valves 51 and conduits 50, is connected to the same pressure medium source that supplies the pressure cell 24 with pressure medium. By supplying pressure medium to the tubes 38, each expansible member 37 may be made to expand. At the periphery of each recess 36 there are arranged metallic sections 42, 43 of triangular cross-section which prevent the expansible member 37 from being pressed out during a pressing operation into the gap between the side supports 30, 31 and the surrounding elements. Each expansible member 37 can be made as one single unit, as shown in FIGS. 2 and 6, or as a composite unit, as shown in FIG. 4, with one part **37*a* having the cast-in flexible tubes 38 and one part 37*b* which may be easily replaceable when wear damage makes replacement necessary. Alternatively, one plastic plate 37 and one metallic plate 49 (see FIG. 5), which protects the plastic plate 37, may be placed in each recess 36**.

A pressure cell press according to the invention can be used with particular advantage for the deep drawing of a sheet workpiece 46 in a cavity tool. In addition to serving as a support for a tool 45, the expansible member 37 can be utilized as a sheet workpiece holder by acting directly, via a wear layer **37*b* or a metallic plate 37*c*, on those parts 46*a*, 46*b* of a workpiece which are bent down against the sides of the tool 45**.

Figure 5:
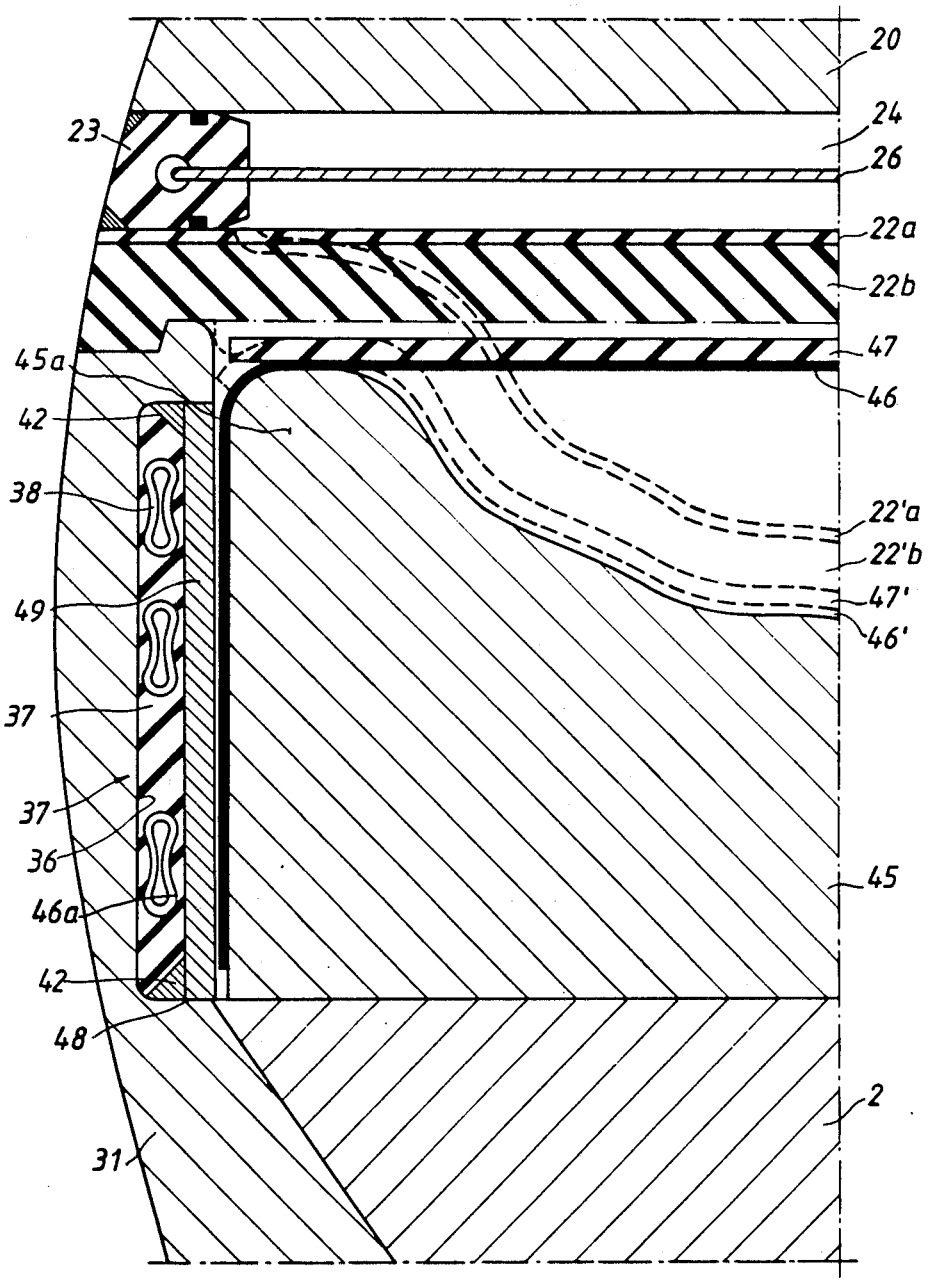
Figure 6:
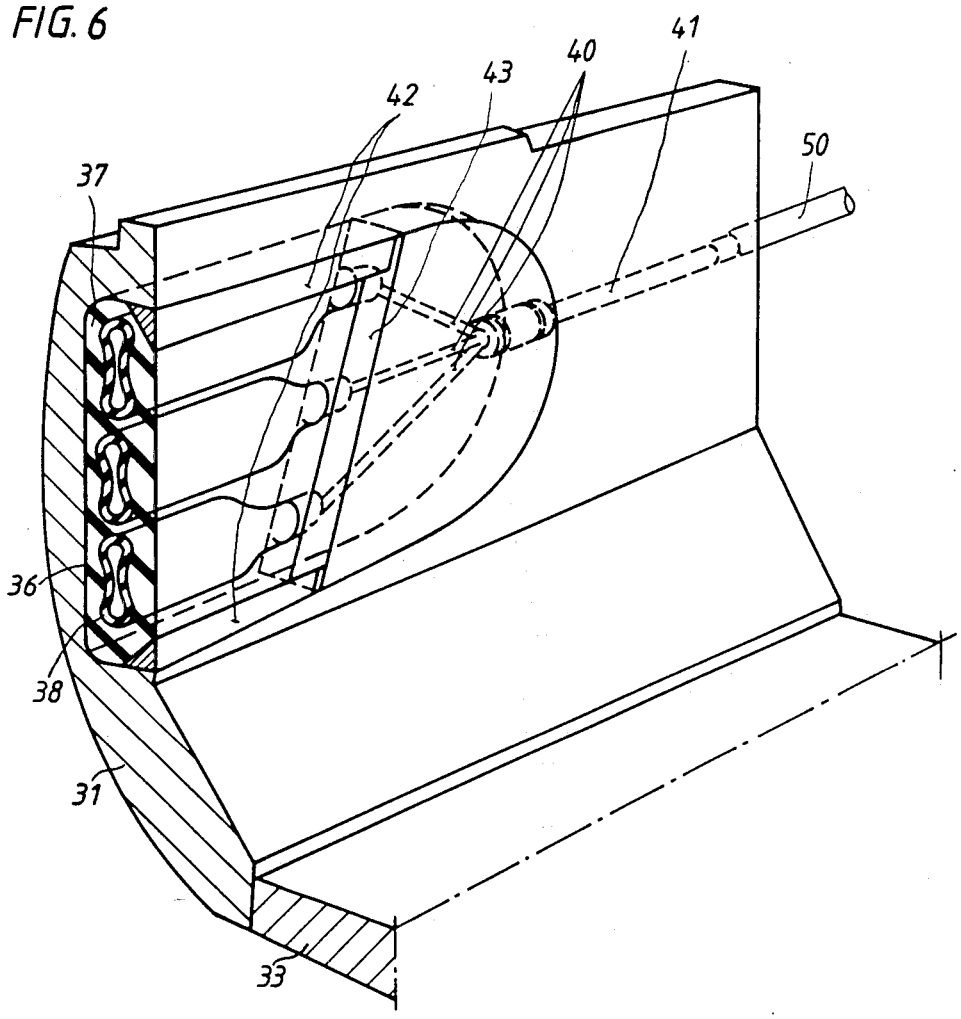
FIG. 6 shows a perspective view of an elongated carrying member forming a side support on one side of the press space.

In FIGS. 2, 4 and 5 a cavity tool is illustrated which almost completely fills up the space between the end wall portions of the tray 2. Between the side portions **45*a*, 45*b* of the tool a gap 48 is provided of such a size as to accommodate the folded-down side portions 46*a* and 46*b* of the sheet workpiece 46. As shown in FIG. 4, a plate 47 of elastic material may be placed on top of the sheet workpiece 46 during a pressing operation, among other things to reduce the stresses on the lower second part 22*b* of the diaphragm 22. The parts 22*a* and 22*b* of the diaphragm 22, the positions of the plate 47 and of the sheet workpiece 46 at the end of a pressing operation are shown by dahed lines and are designated 22'*a*, 22'*b*, 47' and 46'**, respectively.

Figure 7:
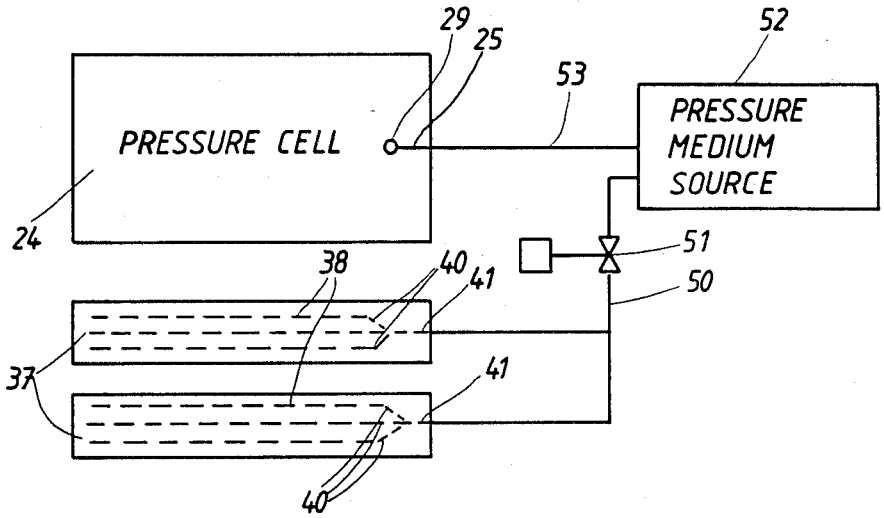
FIG. 7 shows schematically the connection of an expansible side support for a press to a pressure medium source via a pressure-regulating valve.

During deep drawing, each expansible member 37 has two functions. It is utilized both as a workpiece holder and as a support for the outer portions **45*a*, 45*b* of the tool 45. The workpiece can be held with a force depending on the pressure of the fluid medium in the tubes 38. In this case the tubes 38 embedded in the plastic plate of the member 37 are connected via the channels 40, 41 and the conduit 50 with the pressure-regulating valve 51 to a pressure medium source 52, as shown in FIG. 7. The edge portions 45*a*, 45*b* of the tool 45** are supported so that the stresses arising therein are so small that the tool can be made from a cast alloy having a low melting point and a relatively small mechanical strength. The manufacture of each tool is simplified and a given tool is reusable many times. The tool costs will thus be low. A tool can be easily modified, and if necessary the modification can be made by changing a wooden template and recasting the tool using the modified template. The press described is very suitable, due to the low tool costs, for deep drawing sheet metal parts in short runs. It is extremely advantageous for the pressing of sheets during prototype manufacture of, for example, new body models for automobiles. At moderate cost different shapes can be rapidly produced and pressing can be performed under conditions which resemble those used in a mass production situation using steel tools. The design of body parts for automobiles and tools for their manufacture, with respect to possible future production, can be more easily determined.

As will be clear from the foregoing, with reference to the drawings, by means of cavity tools which substantially fill the press space and the use of expansible members at the sides of the working space, a better utilization of the press can be achieved and larger sheets can be pressed in a press stand of a given size than has been possible with prior art press designs.

During pressing of smaller sheel metal parts which require a tool with a smaller width than the working space, it is possible to use a fill-out piece between each expansible plastic plate 37 and the adjacent side of the tool.

The pressure cell 24 and the tubes or hoses 38 in the expansible plate 37 can be connected to a common pressure medium source 52, as shown in FIG. 7. The pressure cell 24 is connected directly to the pressure medium source 52 via a conduit 53 and the channels 25 and 29. The expansible member 37 is connected to the pressure medium source 52 via the conduit 50 and the regulating valve 51, by means of which the desired relationship between the pressure in the pressure cell 24 and each expansible plate 37 can be set at each point of time during a press cycle. The forces holding the edges of the workpiece can thus be controlled in a suitable manner.

The pressure medium source 52 may consists of a hydraulic pump which can provide a pressure of 30–40 MPa (300–400 bar) and a pressure amplifier which may provide a pressure of 100–300 MPa (1000–3000 bar).

I claim:

1. A press of the pressure cell type comprising a press stand having two opposed force-absorbing elements between which a space is formed, a press plate with a recess in which an elastic diaphragm is located and which forms together with the press plate an expansible pressure cell, elongated support means along opposite sides of the said space which constitue attachment means for the diaphragm, a tray located in said space, said tray having an upper tool support surface which defines together with the press plate and the diaphragm a closed press space, a tool located in said closed press space and supported on said support surface, a pressure medium source for pressurizing the pressure cell to urge the diaphragm against a workpiece on said tool for deforming the workpiece against the tool, said elongated support means along said opposite sides each having an open recess facing only said closed press space above said support surface, an expansible member of elastomeric material located in each said recess, each said expansible member forming a side support for support said tool and/or said workpiece during a pressing operation.

2. A press according to claim 1, in which each said expansible member consists of a plastic element which substantially fills said recess in the support means, each said plastic element having at least one cavity connected, via valve means, to said pressure medium source.

3. A press according to claim 2, in which each said cavity is defined by a tube embedded in a mass of elastic material.

4. A press according to claim 1, in which each said expansible member composed an inner part with at least one cavity fillable with pressure medium and an outer solid more wear-resistant part.

5. A press according to claim 2, in which each said expansible member composed an inner part with at least one cavity fillable with pressure medium and an outer solid more wear-resistant part.

6. A press according to claim 4, in which each said outer part comprises a metallic plate arranged side-by-side in each said support means and facing said closed press space.

7. A press according to claim 5, in which each said outer part comprises a metallic plate arranged side-by-side in each said support means and facing said closed press space.

8. A press according to claim 2, in which each said cavity in each said expansible member communicates, via a conduit provided with a pressure regulating valve, with said pressure medium source.

9. A press according to claim 1, in which the expansible member forms a holder for said workpiece to be pressed over the tool during a pressing operation.

* * * * *